US010131463B1

(12) United States Patent
Elstone, Sr.

(10) Patent No.: US 10,131,463 B1
(45) Date of Patent: Nov. 20, 2018

(54) CONTAINER APPARATUS AND METHOD

(71) Applicant: Paul J. Elstone, Sr., Burlington, NJ (US)

(72) Inventor: Paul J. Elstone, Sr., Burlington, NJ (US)

( * ) Notice: Subject to any disclaimer, the term of this patent is extended or adjusted under 35 U.S.C. 154(b) by 0 days.

(21) Appl. No.: 15/589,564

(22) Filed: May 8, 2017

(51) Int. Cl.

| | |
|---|---|
| ***B65D 19/40*** | (2006.01) |
| ***B65D 19/08*** | (2006.01) |
| ***B65D 88/74*** | (2006.01) |
| ***B65D 90/00*** | (2006.01) |
| ***B65D 43/22*** | (2006.01) |

(52) U.S. Cl.
CPC ..... *B65D 19/40* (2013.01); *B65D 19/08* (2013.01); *B65D 43/22* (2013.01); *B65D 88/747* (2013.01); *B65D 90/0033* (2013.01); *B65D 2519/00338* (2013.01)

(58) Field of Classification Search
CPC ..... B65D 19/00; B65D 19/02; B65D 19/08; B65D 19/18; B65D 19/38; B65D 19/40; B65D 43/22; B65D 88/747; B65D 90/0033; B65D 2514/00338; B65D 2519/00338
USPC ..... 206/386, 595–600; 220/1.5, 6, 7
See application file for complete search history.

(56) References Cited

U.S. PATENT DOCUMENTS

| | | | | |
|---|---|---|---|---|
| 4,015,715 A * | 4/1977 | Kelf | ..... | B65D 88/126 206/386 |
| 6,394,003 B1 * | 5/2002 | Lacy, III | ..... | B65D 19/02 108/51.3 |
| 6,902,061 B1 * | 6/2005 | Elstone | ..... | B65D 19/02 206/596 |

* cited by examiner

*Primary Examiner* — Bryon Gehman
(74) *Attorney, Agent, or Firm* — Walter J. Tencza, Jr.

(57) ABSTRACT

A container having a base, with a bottom surface, a first support tube fixed to the base at a first level below and substantially parallel to the bottom surface of the base; a second support tube fixed to the base at the first level below and substantially parallel to the bottom surface of the base, and spaced apart from, substantially parallel to the first support tube; a third support tube fixed to the base, at a second level below and substantially parallel to the bottom surface, and below and substantially parallel to the first level; and a fourth support tube fixed to the base, at the second level below and substantially parallel to the bottom surface of the base, and spaced apart from, and substantially parallel to the third support tube. The first and second support tubes may be substantially perpendicular to the third and fourth support tubes.

14 Claims, 19 Drawing Sheets

CONTAINER APPARATUS AND METHOD

FIELD OF THE INVENTION

This invention relates to improved methods and apparatus concerning containers.

BACKGROUND OF THE INVENTION

There are various devices known for containers.

SUMMARY OF THE INVENTION

In at least one embodiment of the present application, an apparatus is provided comprising a container having a base, wherein the base has a bottom surface; a first support tube fixed to the base of the container, such that the first support tube is fixed at a first level below and substantially parallel to the bottom surface of the base; a second support tube fixed to the base of the container, such that the second support tube is fixed at the first level below and substantially parallel to the bottom surface of the base, and spaced apart from, substantially parallel to the first support tube; a third support tube fixed to the base of the container, such that the third support tube is fixed at a second level below and substantially parallel to the bottom surface of the base, and below and substantially parallel to the first level; and a fourth support tube fixed to the base of the container, such that the fourth support tube is fixed at the second level below and substantially parallel to the bottom surface of the base, and spaced apart from, and substantially parallel to the third support tube. In at least one embodiment, the first and second supports tubes are substantially perpendicular to the third and fourth support tubes.

The apparatus may further include a fifth support tube fixed to the base of the container, such that the fifth support tube is fixed at the first level below and substantially parallel to the bottom surface of the base; and a sixth support tube fixed to the base of the container, such that the sixth support tube is fixed at the first level below and substantially parallel to the bottom surface of the base, and spaced apart from, substantially parallel to the fifth support tube; wherein the fifth and sixth supports tubes are substantially perpendicular to the third and fourth support tubes; wherein the first and fifth support tubes are substantially aligned; and wherein the second and sixth support tubes are substantially aligned. In at least one embodiment, the bottom surface of the base may have an opening through which liquid can pass.

The third and fourth support tubes may be configured with respect to each other, and sized, to allow a first fork lift tine of a fork lift to be inserted into the third support tube, while a second fork lift tine of the fork lift is simultaneously inserted into the fourth support tube.

The first and second support tubes may be configured with respect to each other, and sized to allow a first support to be inserted into the first support tube, while a second support is simultaneously inserted into the second support tube in order to cause the container, and first, second, third, and fourth support tubes, to be raised a distance, above a ground surface, parallel to the bottom surface of the base of the container, In at least one embodiment, the first, second, third, and fourth support tubes are configured with respect to each other, and sized to allow a first support to be inserted into the first support tube, while a second support is simultaneously inserted into the second support tube, while a third support is simultaneously inserted into the fifth support tube, and while a sixth support is simultaneously inserted into the sixth support tube, in order to cause the container, and first, second, third, fourth, fifth, and sixth support tubes, to be raised a distance, above a ground surface, parallel to the bottom surface of the base of the container.

In at least one embodiment, the third and fourth support tubes are configured with respect to each other, and sized, to allow a first fork lift tine of a fork lift to be inserted into the third support tube, while a second fork lift tine of the fork lift is simultaneously inserted into the fourth support tube, and while the first, second, third, and fourth supports are inserted into the first, second, fifth, and sixth support tubes.

In at least one embodiment, a method is provided comprising the steps of inserting a first support into a first support tube, while a second support is simultaneously inserted into a second support tube, while a first forklift tine of a forklift is inserted into a third support tube, and while a second forklift tine of the forklift is inserted into a fourth support tube.

The first support tube may be fixed to a base of a container, such that the first support tube is fixed at a first level below and substantially parallel to the bottom surface of the base; the second support tube may be fixed to the base of the container, such that the second support tube is fixed at the first level below and substantially parallel to the bottom surface of the base, and spaced apart from, substantially parallel to the first support tube; the third support tube may be fixed to the base of the container, such that the third support tube is fixed at a second level below and substantially parallel to the bottom surface of the base, and below and substantially parallel to the first level; and the fourth support tube may be fixed to the base of the container, such that the fourth support tube is fixed at the second level below and substantially parallel to the bottom surface of the base, and spaced apart from, and substantially parallel to the third support tube. The first and second supports tubes may be substantially perpendicular to the third and fourth support tubes.

The method may further include Inserting a third support into a fifth support tube and a fourth support into a sixth support tube, while the first and second supports are inserted into the first and second support tubes; wherein the fifth support tube is fixed to the base of the container, such that the fifth support tube is fixed at the first level below and substantially parallel to the bottom surface of the base; wherein the sixth support tube is fixed to the base of the container, such that the sixth support tube is fixed at the first level below and substantially parallel to the bottom surface of the base, and spaced apart from, substantially parallel to the fifth support tube; wherein the fifth and sixth supports tubes are substantially perpendicular to the third and fourth support tubes; wherein the first and fifth support tubes are substantially aligned; and wherein the second and sixth support tubes are substantially aligned.

The method may further include lifting the container above a ground surface, by moving the first forklift tine and the second forklift tine simultaneously upwards, while the first forklift tine is inserted in the third support tube and the second forklift tine is inserted in the fourth support tube.

DETAILED DESCRIPTION OF THE DRAWINGS

Figure 1:
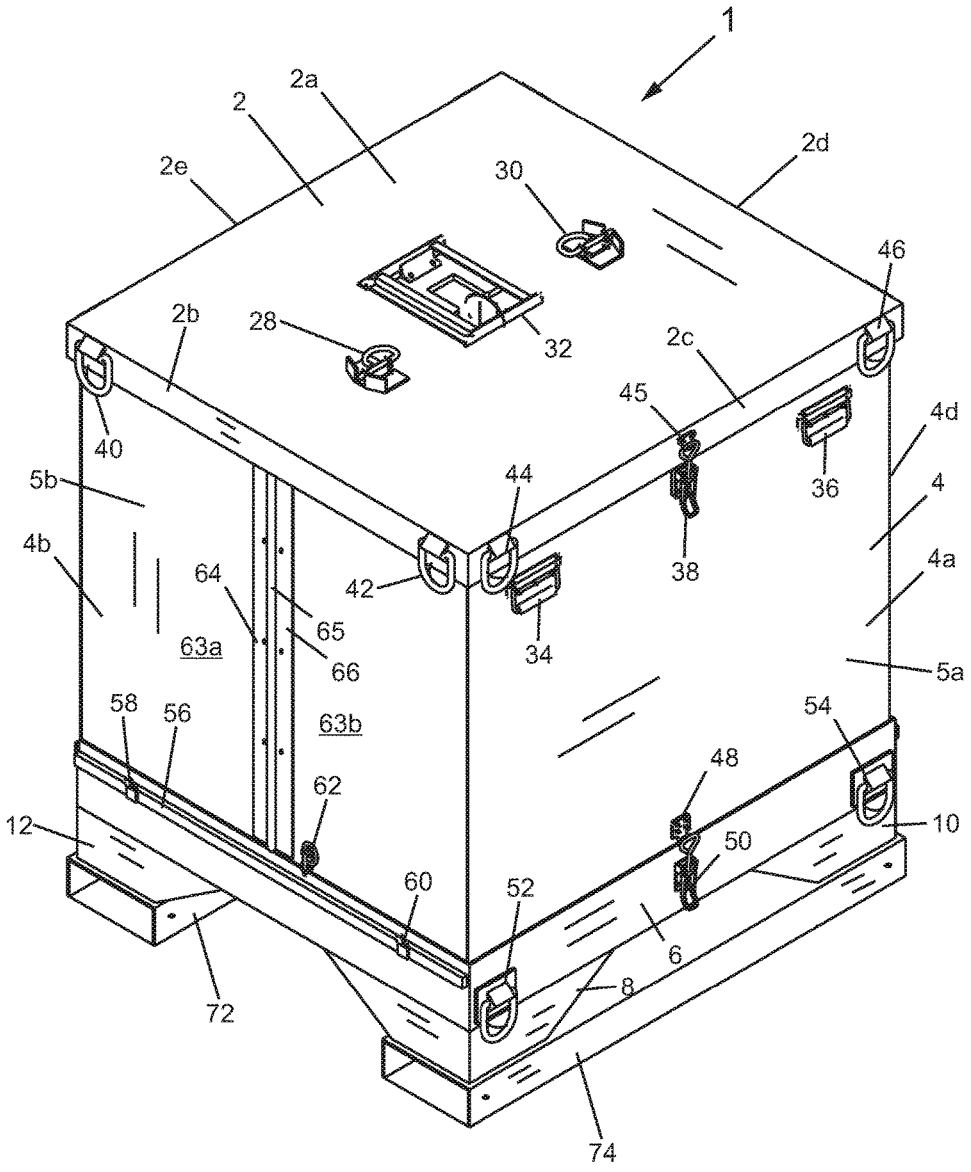
Fig. 1 (Prior Art)
FIG. 1 shows a top, front, and left side perspective view of a known apparatus, with the apparatus of FIG. 1 shown in a non compressed state.

FIG. 1 shows a top, front, and left side perspective view of a known prior art apparatus 1, with the apparatus of FIG. 1 shown in a non compressed state. Parts of the known apparatus 1 are part of an apparatus 200, in accordance with an embodiment of the present invention.

The apparatus 200, in accordance with an embodiment of the present invention is referred to in whole or in part, in FIGS. 2-12G.

Figure 2:
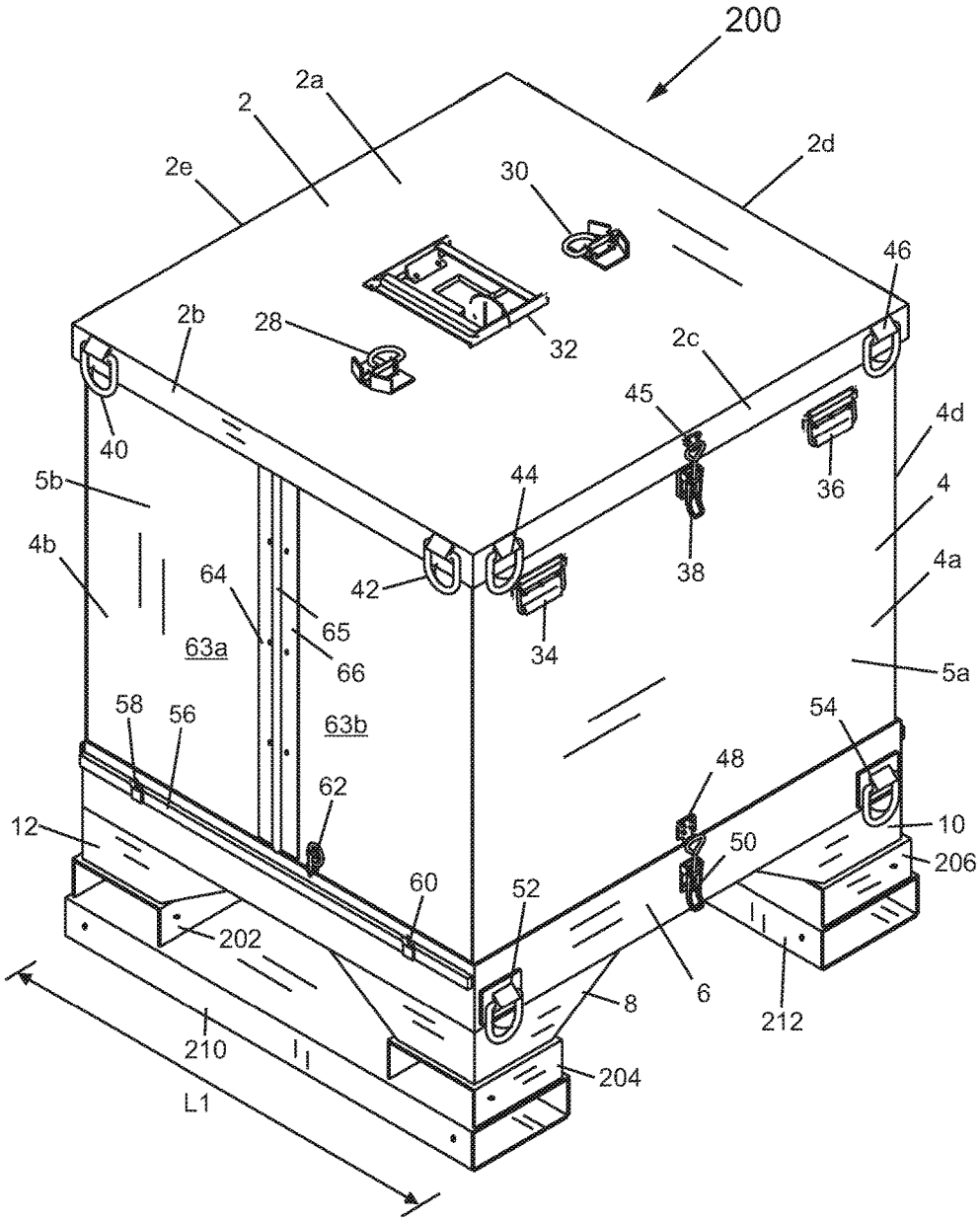
FIG. 2 shows a top, front, and left side perspective view of an apparatus in accordance with an embodiment of the present invention, with the apparatus shown in a non compressed state.
Figure 3:
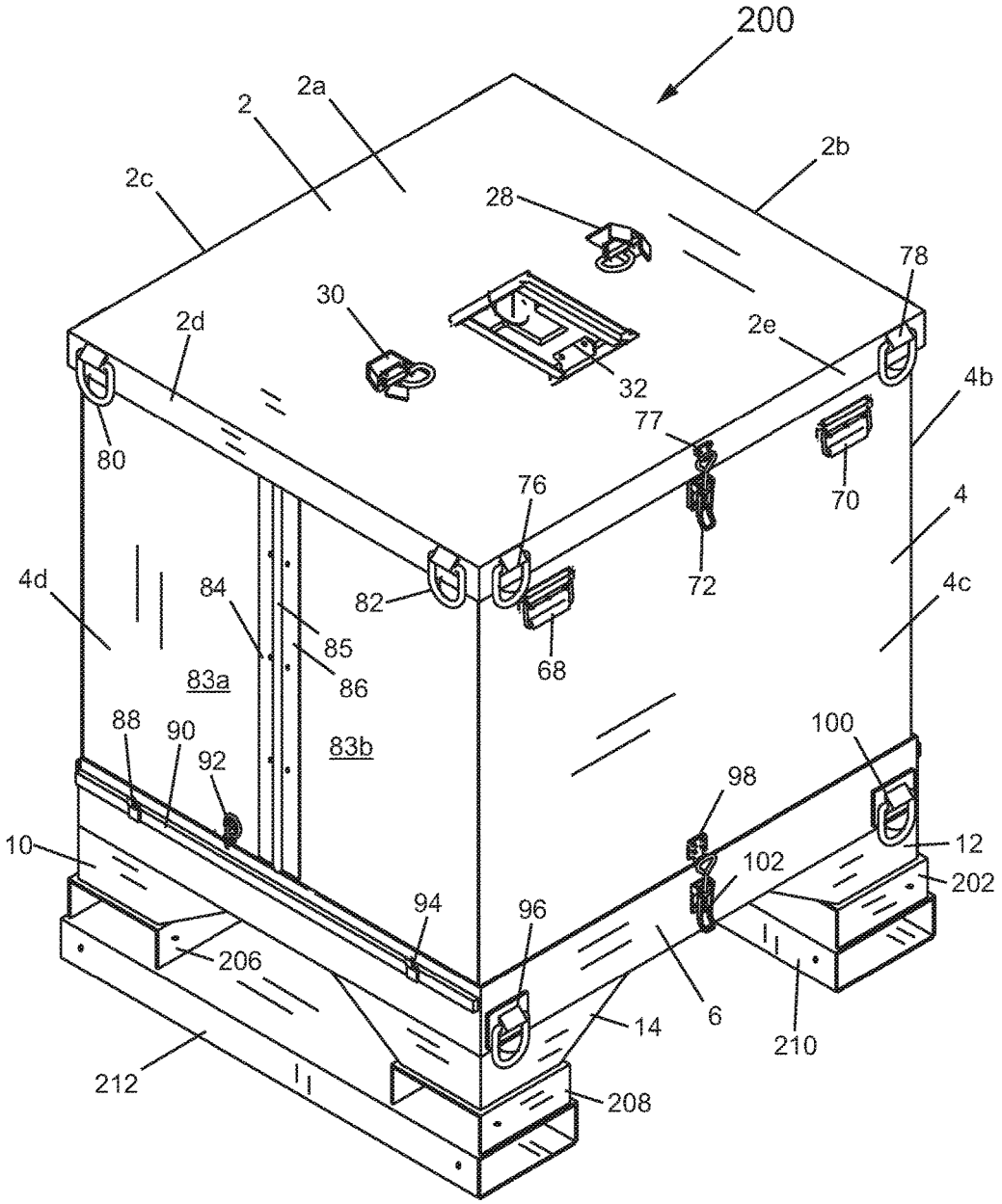
FIG. 3 shows a top, rear, and right side perspective view of the apparatus of FIG. 2, with the apparatus of FIG. 1 shown in a non compressed state.

Referring to FIGS. 2-3, the apparatus 200 includes a lid or top device 2, a first wall section 4*a*, a third wall section 4*b*, a second wall section 4*c*, a fourth wall section 4*d*, a base 6, and supports 8, 10, 12, and 14, which are also shown in the known apparatus 1 of FIG. 1. The lid or top device 2 includes, or has attached thereto, handle devices 28 and 30 and device 32. The lid or top device also includes, or has attached thereto, handles devices 40, 42, 44, 46, 76, 78, 80, and 82. The lid or top device 2 includes a top plate or surface 2*a* and side plates or surfaces 2*b*, 2*c*, 2*d*, and 2*e*, which form a box top structure. The plates 2*a*-*e* may be made of a hard material such as a hard metal. The lid or top device 2 also includes latching devices 45.

The apparatus 200 also includes supports 202, 204, 206, and 208, and well as fork lift tubes or supports 210 and 212 as shown in FIGS. 2 and 3. The known apparatus 1 does not include the combination of supports 202, 204, 206, and 208 and fork lift tubes or supports 210 and 212 in the configuration shown in FIGS. 2-3. The known apparatus 1 only includes tube or supports 72 and 74. In accordance with an embodiment of the present invention, the combination of supports 202, 204, 206, and 208 and supports 210 and 212 in the configuration shown, allows the apparatus 200 to be supported in the manner shown in FIGS. 9A-9D by supports or stands 300, 310, 320, and 330, so that water can be accessed from opening 6*f* in the apparatus 200, and allowing the apparatus 200 to be lifted up by inserting one tine of a fork lift in tube 210 and at the same time one tine of the fork lift into tube 212, to thereby lift up the apparatus 200 and move it while the supports 300, 310, 320, and 330 are still inserted in supports or tubes 204, 206, 208, and 202, respectively.

Figure 4:
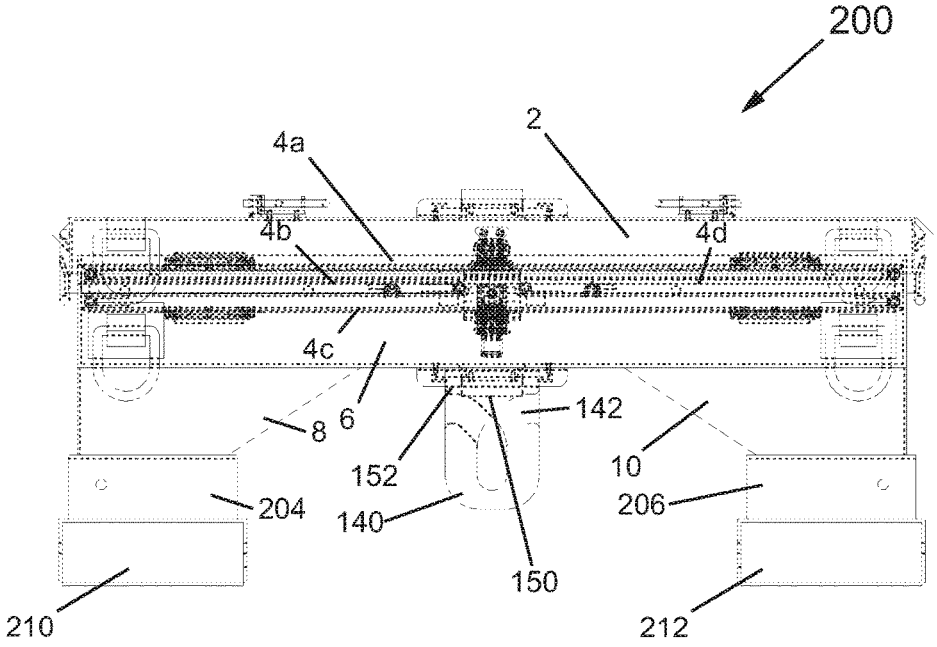
FIG. 4 shows a front view of the apparatus of FIG. 2, with the apparatus of FIG. 2 shown in a compressed state.

FIG. 4 shows a front view of the apparatus 200 of FIG. 2, with the apparatus 200 of FIG. 2 shown in a compressed state. In the compressed state, sections 63*a* and 63*b* of wall section 4*b* are folded on top of one another and sit under half of wall section 4*a*, sections 83*a* and 83*b* of wall section 4*d* are folded on top of one another and sit under the other half of wall section 4*a*, and sections, and wall section 4*c* sits under wall sections 4*a*, 4*b*, and 4*d* as shown by dashed lines in FIG. 4.

The components 4*a*, 4*b*, 4*c*, 6, 8, 10, 140, 142, 150, and 152 may all be known components which are part of known apparatus 1 of FIG. 1. Each of the components 140 and 142 may be J-shaped metal plates which are configured to hold a pipe in place substantially parallel to the bottom surface 6*e*, shown in FIG. 12A, and underneath the bottom surface 6*e*. The component 150 may be an opening or a coupling for an opening to connect a section of pipe perpendicular to the surface 6*e*, and to the opening 6*f*, in order to drain water from a chamber enclosed by bottom surface 6*e* of FIG. 12A and walls 4*a*, 4*b*, 4*c*, and 4*d* of the apparatus 200 and the known apparatus 1 of FIG. 1.

Figure 5A:
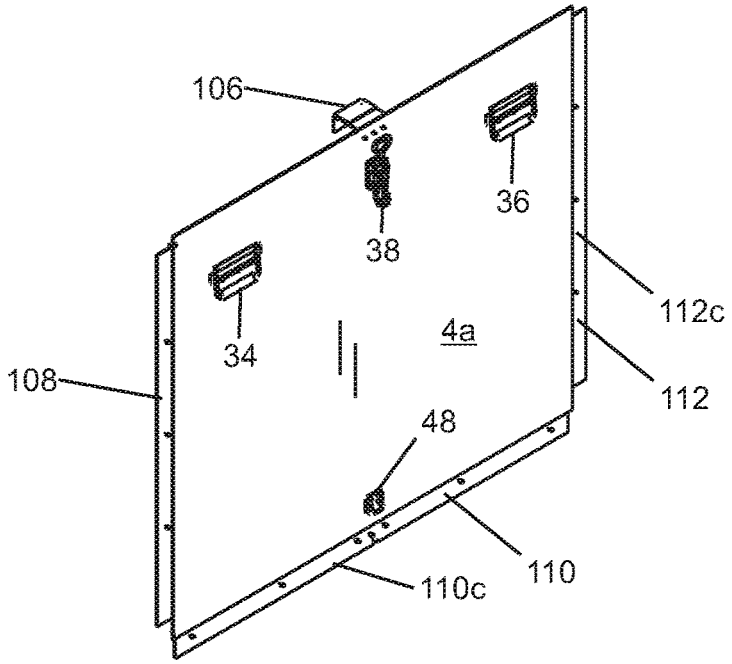
FIG. 5A shows a top, front, and left side perspective view of a first wall section of the apparatus of FIG. 2.
Figure 5B:
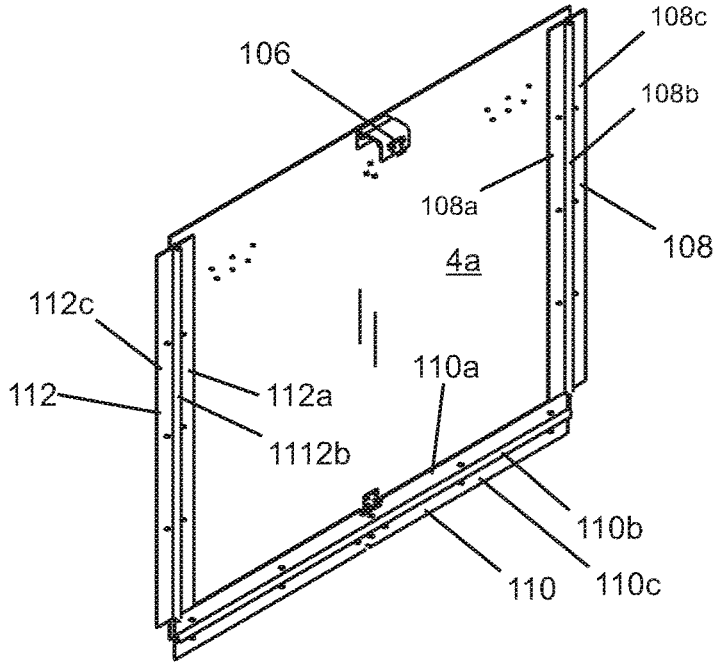
FIG. 5B shows a top, rear, and right side perspective view of the first wall section of FIG. 5A.

FIG. 5A shows a top, front, and left side perspective view of a first wall section 4*a* of the apparatus 200 of FIG. 2, and of the apparatus 1 of FIG. 1. FIG. 5B shows a top, rear, and right side perspective view of the first wall section 4*a* of FIG. 5A. The first wall section 4*a* includes a plate or surface 5*a*, which may be made of a hard metal material. The first wall section 4*a* further includes handle devices 34 and 36, latching devices 38 and 106, device 48, and members 108, 110, and 112. The member 108 includes plates 108*a* and 108*c*, which are rotatably connected together by a hinge 108*b*; the member 110 includes plates 110*a* and 110*c*, which are rotatably connected together by a hinge 110*b*; and the member 112 includes plates 112*a* and 112*c*, which are rotatably connected together by a hinge 112*b*. The combination of members 108*a-c* or members 110*a-c* or members 112*a-c* may be called a hinge.

The hinge of members 108*a-c*, is rotatably connected to the fourth wall section 4*d*, and allows the first wall section 4*a* to pivot with respect to the fourth wall section 4*d*; the hinge of members 110*a-c* is rotatably connected to the base 6 and allows the first wall section 4*a* to pivot with respect to the base 6; and the hinge of members 112*a-c* is rotatably connected to the third wall section 4*b*, and allows the first wall section 4*a* to pivot with respect to the third wall section 4*b*.

Figure 6A:
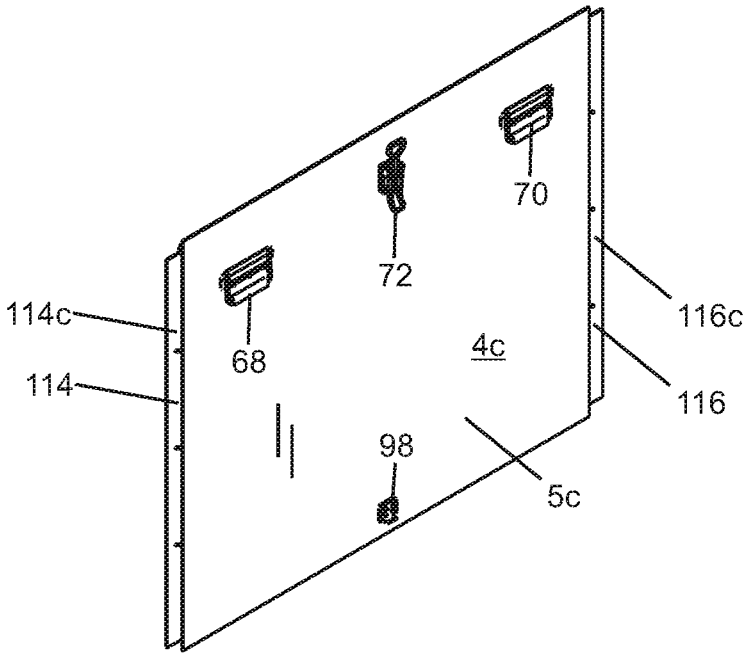
FIG. 6A shows a top, rear, and right side perspective view of a second wall section of the apparatus of FIG. 2.
Figure 6B:
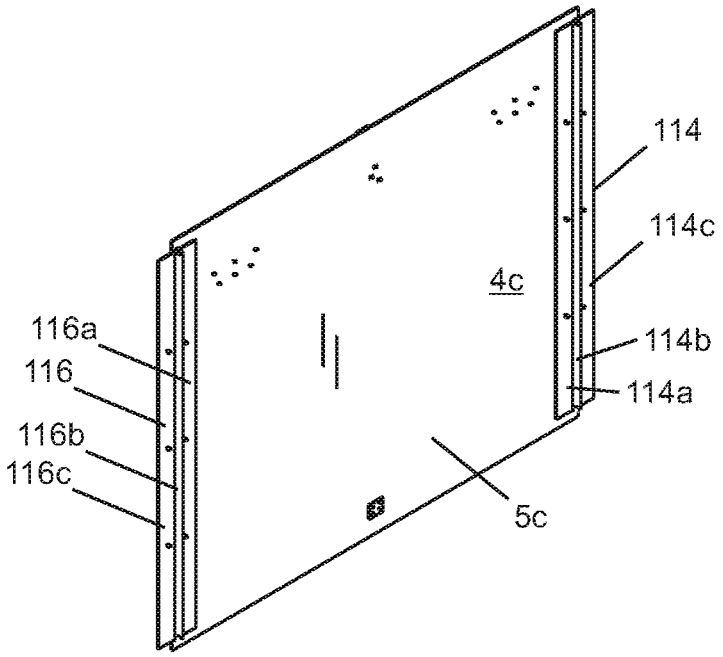
FIG. 6B shows a top, front, and left side perspective view of the second wall section of FIG. 6A.

FIG. 6A shows a top, rear, and right side perspective view of a second wall section 4*c* of the apparatus 200 of FIG. 2 and the apparatus 1 of FIG. 1. FIG. 6B shows a top, front, and left side perspective view of the second wall section 4*c* of FIG. 6A. The second wall section 4*c* may be a mirror image or identical to the first wall section 4*a*, unless otherwise described.

The second wall section 4*c* includes a plate or surface 5*c*, which may be made of a hard metal material. The second wall section 4*c* further includes handle devices 68 and 70, latching device 72 and a device 98, and members 114 and 116. The member 114 includes plates 114*a* and 114*c*, which are rotatably connected together by a hinge 114*b*; and the member 116 includes plates 116*a* and 116*c*, which are rotatably connected together by a hinge 116*b*. The combination of members 114*a-c* or members 116*a-c* may be called a hinge.

The hinge of members 114*a-c*, is rotatably connected to the fourth wall section 4*d*, and allows the second wall section 4*c* to pivot with respect to the fourth wall section 4*d*; the hinge of members 116*a-c* is rotatably to the third wall section 4*b*, and allows the second wall section 4*c* to pivot with respect to the third wall section 4*b*.

Figure 7A:
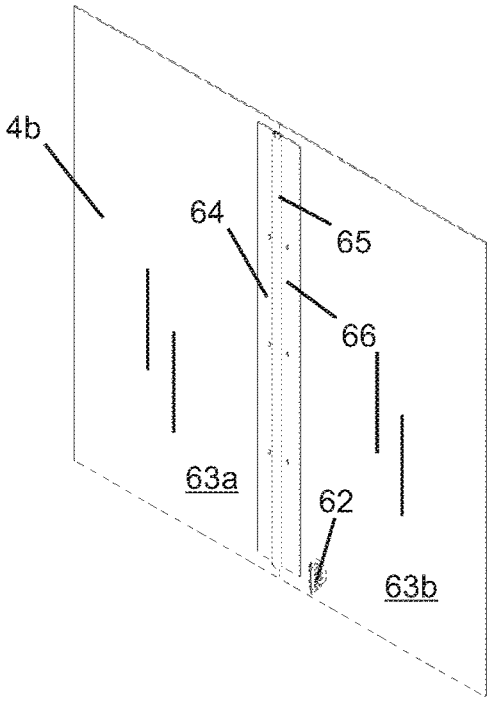
FIG. 7A shows a top, left, and front side perspective view of a third wall section of the apparatus of FIG. 2.
Figure 7B:
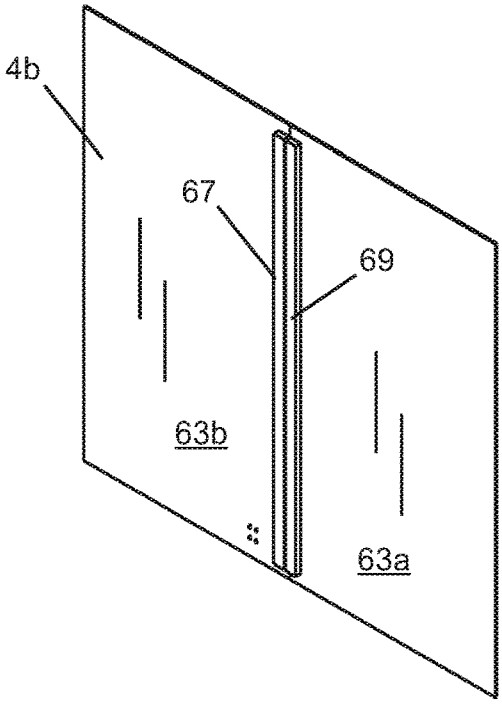
FIG. 7B shows a top, right, and rear side perspective view of the third wall section of the apparatus of FIG. 2.

FIG. 7A shows a top, left, and front side perspective view of a third wall section 4*b* of the apparatus 200 of FIG. 2 and the apparatus 1 of FIG. 1. FIG. 7B shows a top, right, and rear side perspective view of the third wall section 4*b* of the apparatus 200 of FIG. 2 and the apparatus 1 of FIG. 1. The third wall section 4*b* includes plates or members 63*a* and 63*b* joined together by plate 64, hinge 65, and plate 66, and reinforced by members 67 and 69. The plate 64, hinge 65, and plate 66 together may be described as a hinge and the member 63*a* can be folded on top of the member 63*b* using hinge 64, 65, and 66. The third wall section 4*b* may also include device 62.

Figure 8A:
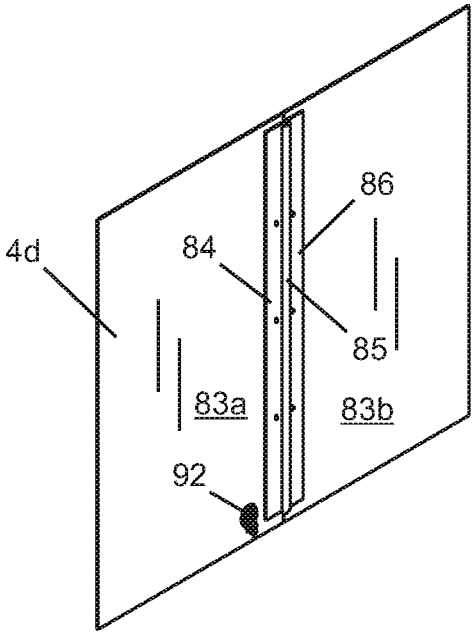
FIG. 8A shows a top, right, and front side perspective view of a fourth wall section of the apparatus of FIG. 2.
Figure 8B:
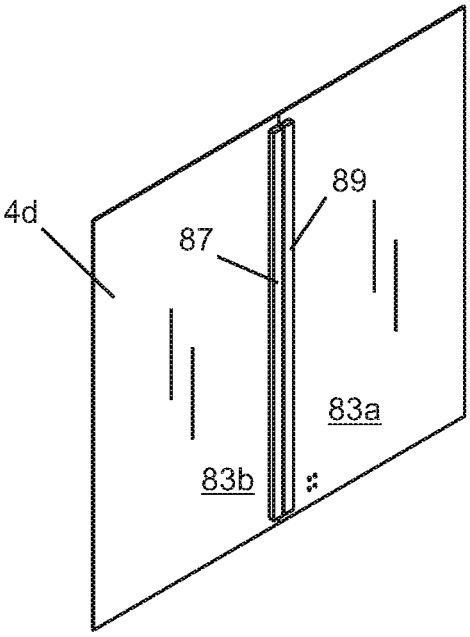
FIG. 8B shows a top, left, and rear side perspective view of the fourth wall section of the apparatus of FIG. 2.

FIG. 8A shows a top, left, and front side perspective view of a wall section 4*d* of the apparatus 200 of FIG. 2 and the apparatus 1 of FIG. 1. FIG. 8B shows a top, right, and rear side perspective view of the third wall section 4*d* of the apparatus 200 of FIG. 2 and the apparatus 1 of FIG. 1. The third wall section 4*d* includes plates or members 83*a* and 83*b* joined together by plate 84, hinge 85, and plate 86, and reinforced by members 87 and 89. The plate 84, hinge 85, and plate 86 together may be described as a hinge and the member 83*a* can be folded on top of the member 83*b* using hinge 84, 85, and 86. The third wall section 4*d* may also include device 92.

Figure 9A:
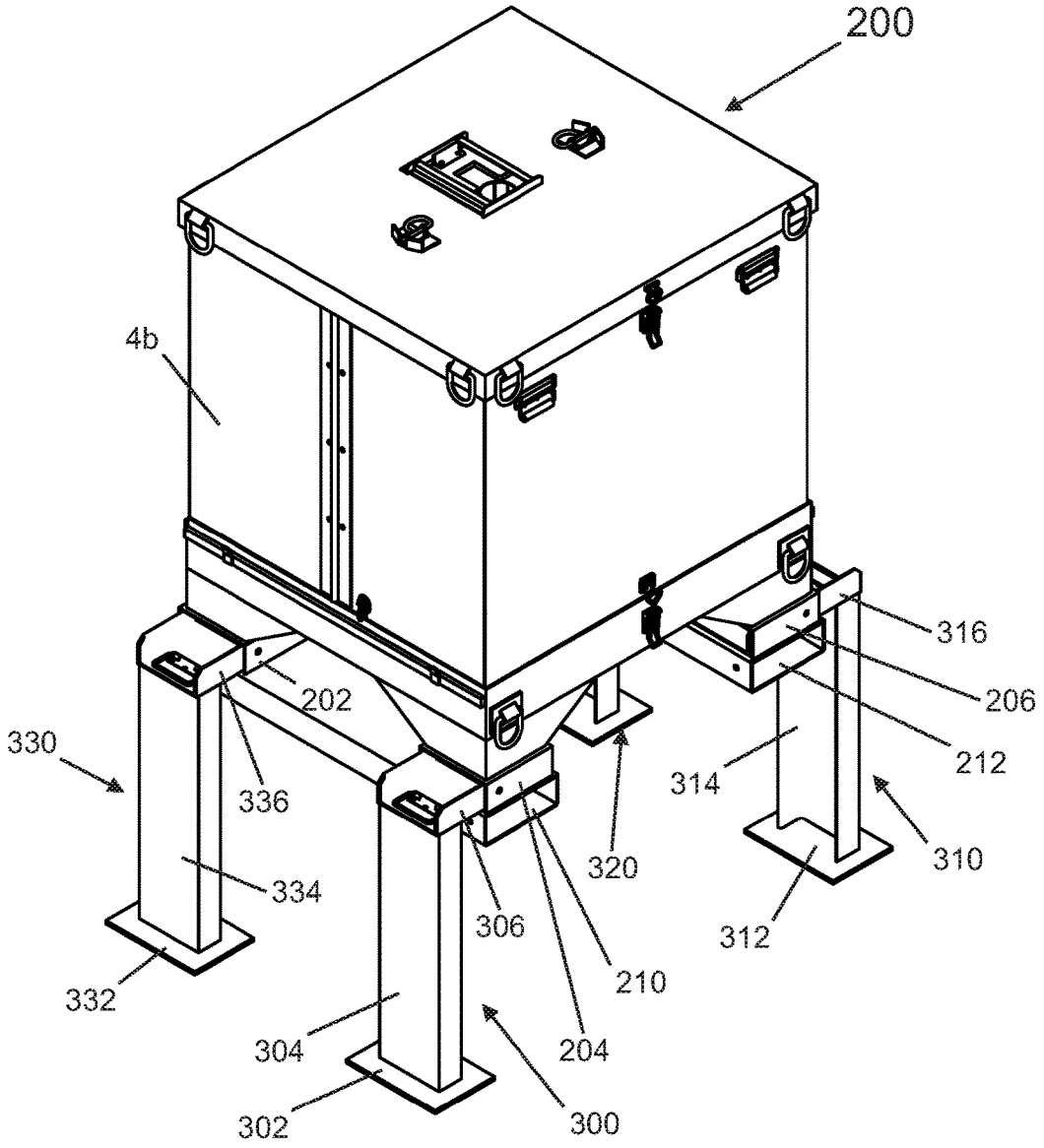
FIG. 9A shows a top, front, and left side perspective view of the apparatus of FIG. 2 held up by a support apparatus.
Figure 9B:
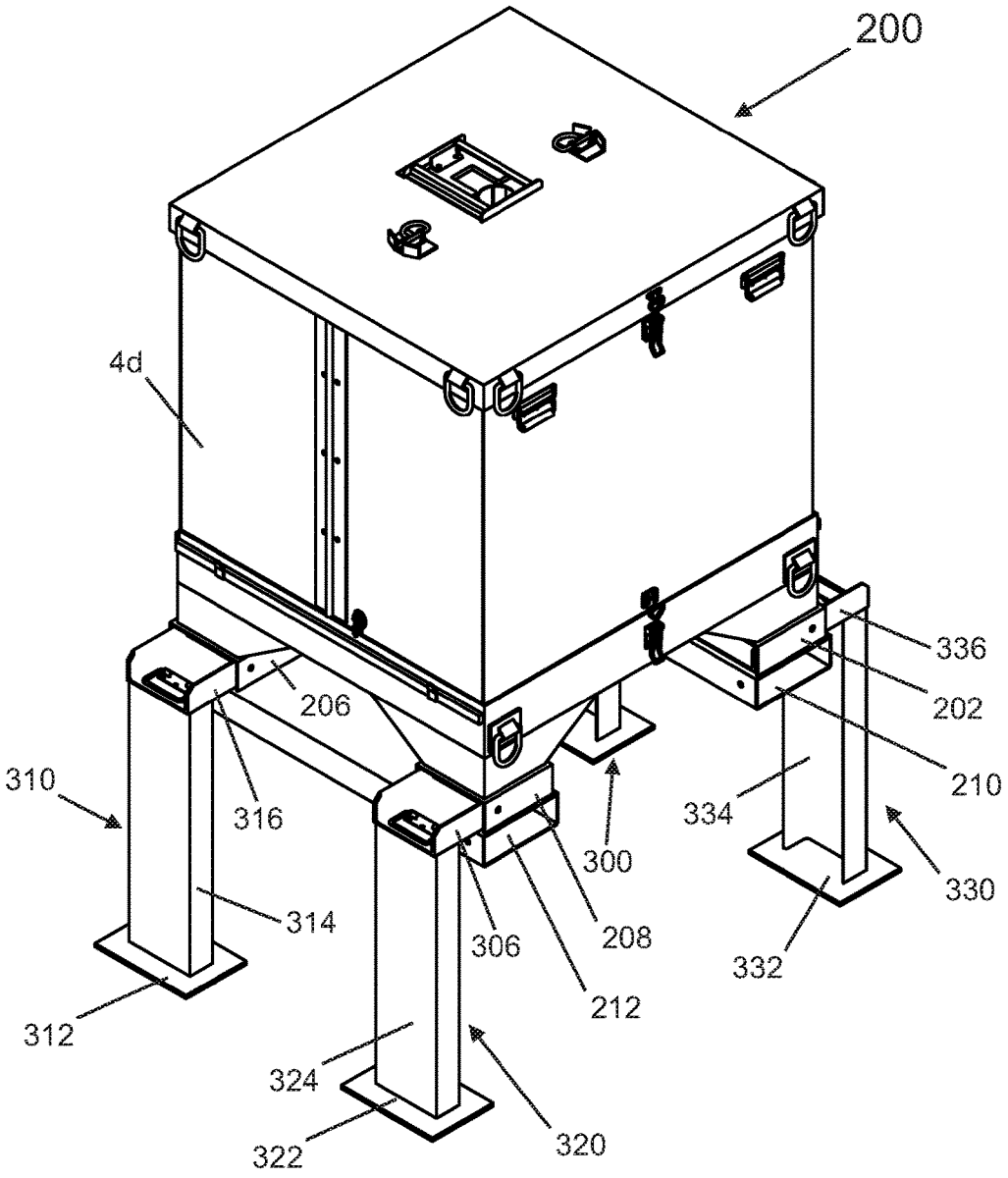
FIG. 9B shows a top, rear, and right side perspective view of the apparatus of FIG. 2 held up by the support apparatus shown in FIG. 9A.

FIG. 9A shows a top, front, and left side perspective view of the apparatus 200 of FIG. 2 held up by a support apparatus including supports 300, 310, 320, and 330. FIG. 9B shows a top, rear, and right side perspective view of the apparatus 200 of FIG. 2 held up by the support apparatus shown in FIG. 9A.

The support 300 includes base 302, vertical member 304 and horizontal member 306, which is substantially perpendicular or perpendicular to the vertical member 304. Similarly or identically, the support 310 includes base 312, vertical member 314 and horizontal member 316, which is substantially perpendicular or perpendicular to the vertical member 314. Similarly or identically, the support 320 includes base 322, vertical member 324 and horizontal member 326, which is substantially perpendicular or perpendicular to the vertical member 324. Similarly or identically, the support 330 includes base 332, vertical member 334 and horizontal member 336, which is substantially perpendicular or perpendicular to the vertical member 334. The supports 300, 310, 320, and 330 may be made substantially or entirely of a hard, rigid metal.

In the combination of FIGS. 9A-9B, the horizontal members 306, 316, 326, and 336 are shown inserted in the supports or tubes 204, 206, 208 and 202, respectively. Unlike the tubes 72 and 74 of FIG. 1, the supports or tubes 204, 206, 208, and 202, do not go all the way across the width of the walls 4*a* and 4*c*, rather there is a gap between tubes 204 and 206 and a gap between tubes 208 and 202, which allows a pipe, such as pipe 160 shown by dashed lines in FIG. 12G, to be connected at opening 6*f* of FIG. 12G, to not be impeded by an additional structure.

Figure 9C:
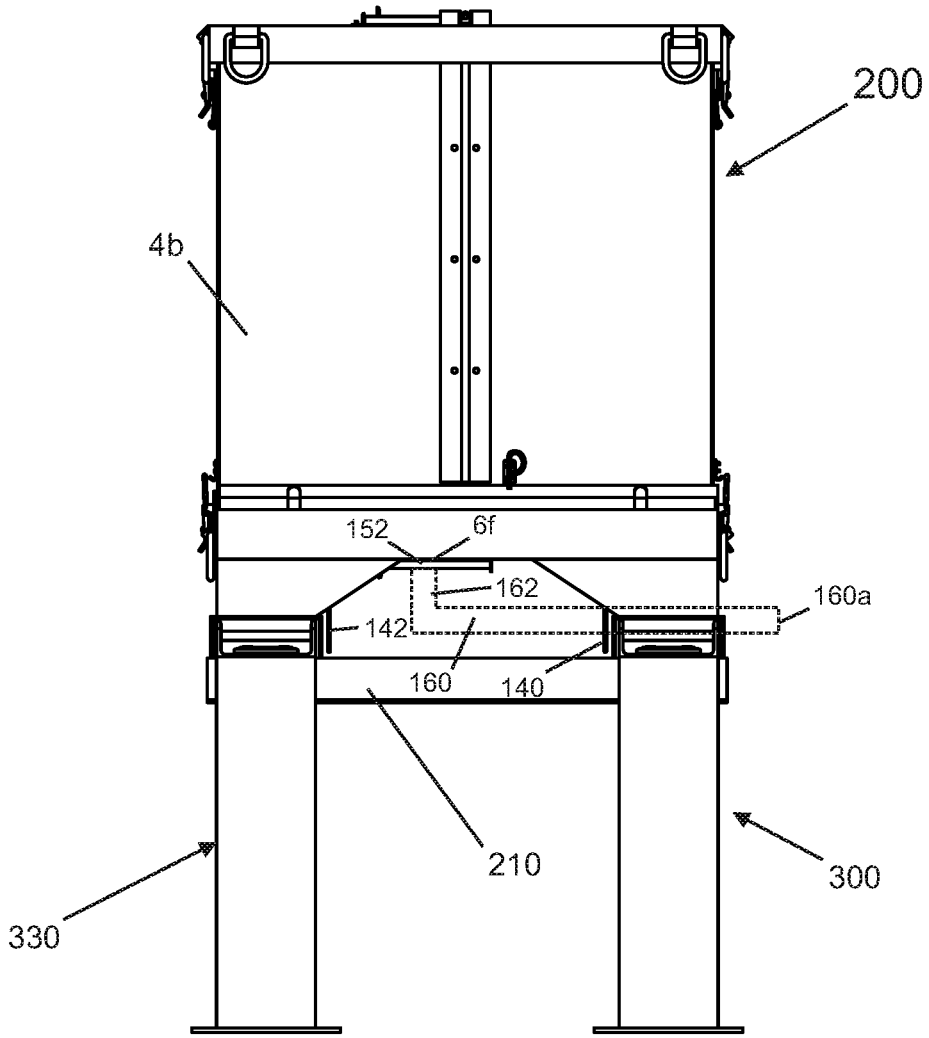
FIG. 9C shows a left side view of the apparatus of FIG. 2 held up by the support apparatus shown in FIG. 9A.

FIG. 9C shows a left side view of the apparatus 200 of FIG. 2 held up by the support apparatus shown in FIG. 9A. In FIG. 9C, dashed lines are shown for a vertical pipe 162 connected to or at opening 6*f*, and dashed lines are shown for a horizontal pipe 160 connected to the vertical pipe 162. Water may be drained from the chamber, enclosed by walls 7 and bottom surface 6*e*, through opening 6*f*, then through pipe 162 and then through pipe 160 and out opening 160*a*.

Figure 9D:
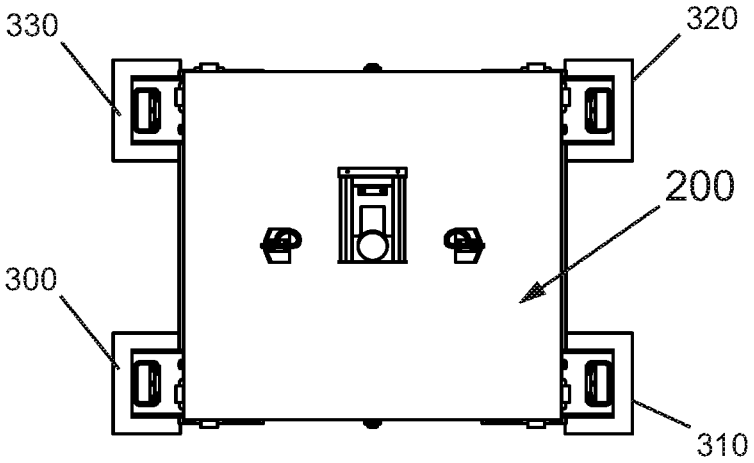
FIG. 9D shows a top view of the apparatus of FIG. 2 held up by the support apparatus shown in FIG. 9A.
Figure 9E:
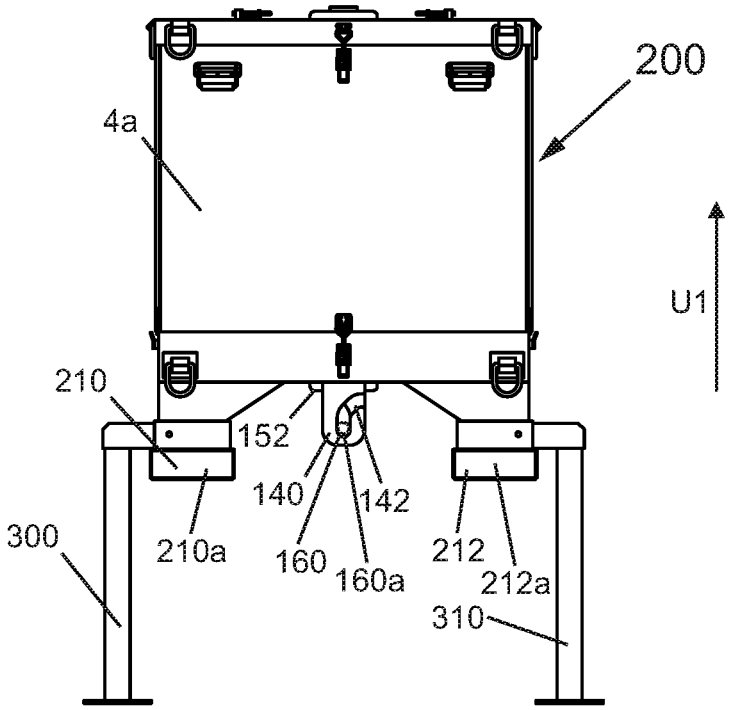
FIG. 9E shows a front view of the apparatus of FIG. 2 held up by the support apparatus shown in FIG. 9A.

FIG. 9D shows a top view of the apparatus 200 of FIG. 2 held up by the support apparatus, including supports 300, 310, 320, and 330, shown in FIG. 9A. FIG. 9E shows a front view of the apparatus 200 of FIG. 2 held up by the support apparatus 300, 310, 320, and 330 shown in FIG. 9A. The location of pipe 160 and opening 160*a* is shown in FIG. 9D. The pipe 160 may be held up by J-shaped member 140 and/or J-shaped member 142.

Figure 10:
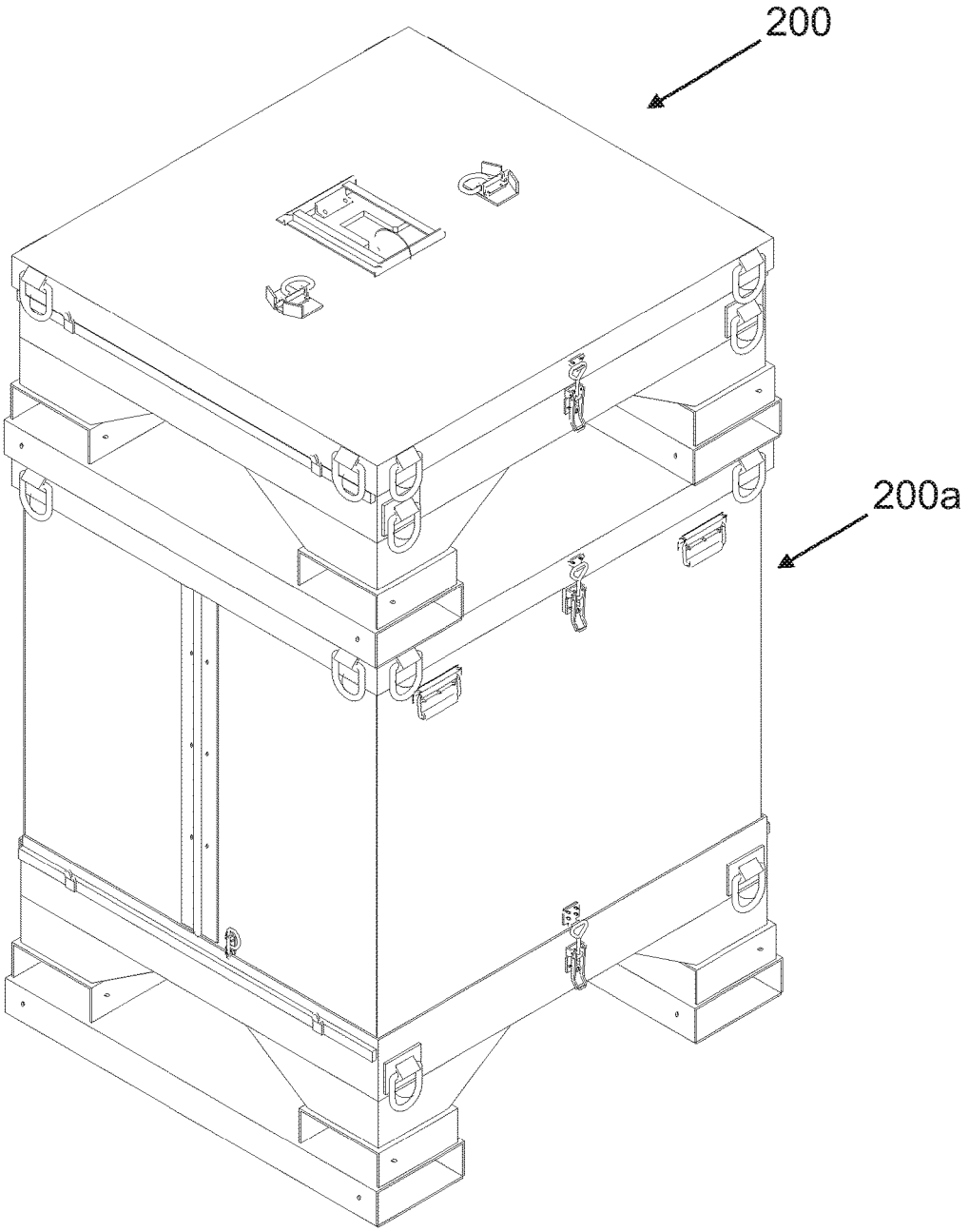
FIG. 10 shows a top, front, and left side perspective view of the apparatus of FIG. 2 in a compressed state on top of a second apparatus, identical to the apparatus of FIG. 2, with the second apparatus in a non-compressed state.

FIG. 10 shows a top, front, and left side perspective view of the apparatus 200 of FIG. 2 in a compressed state on top of a second apparatus 200*a*, identical to the apparatus 200 of FIG. 2, with the second apparatus 200*a* in a non-compressed state.

Figure 11:
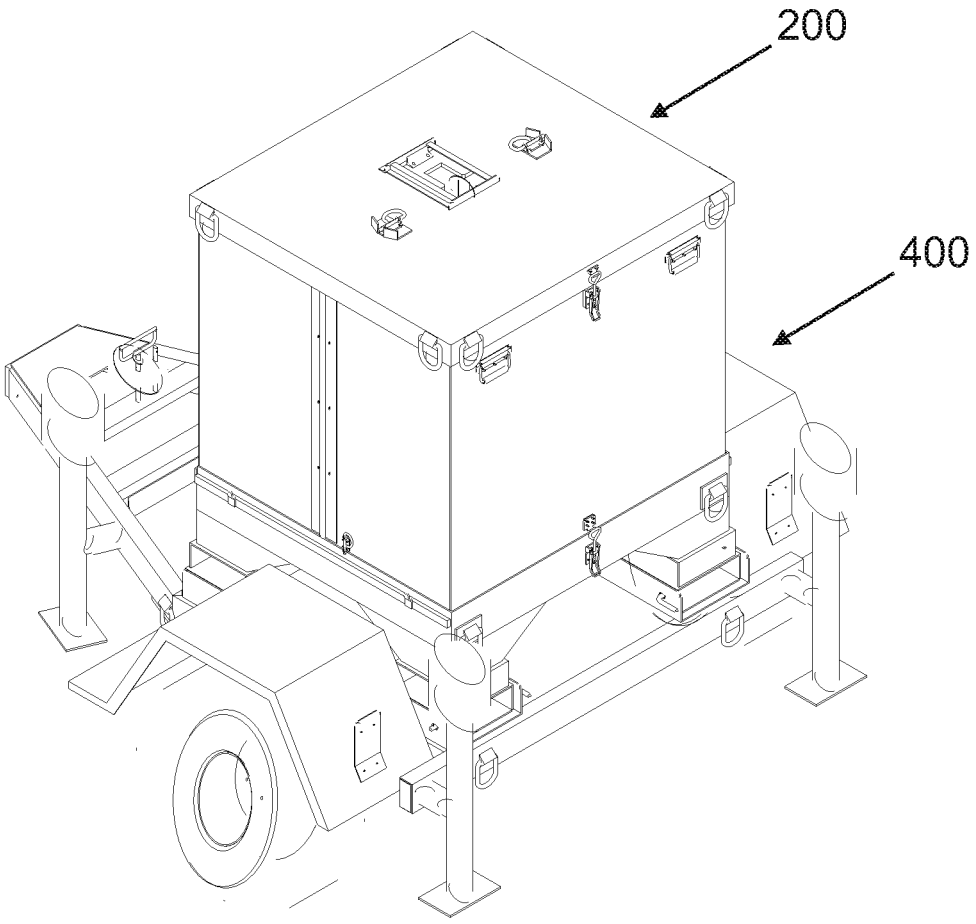
FIG. 11 shows a top, front, and left side perspective view of the apparatus of FIG. 2 placed on a trailer apparatus.

FIG. 11 shows a top, front, and left side perspective view of the apparatus 200 of FIG. 2 placed on a trailer apparatus 400.

Figure 12A:
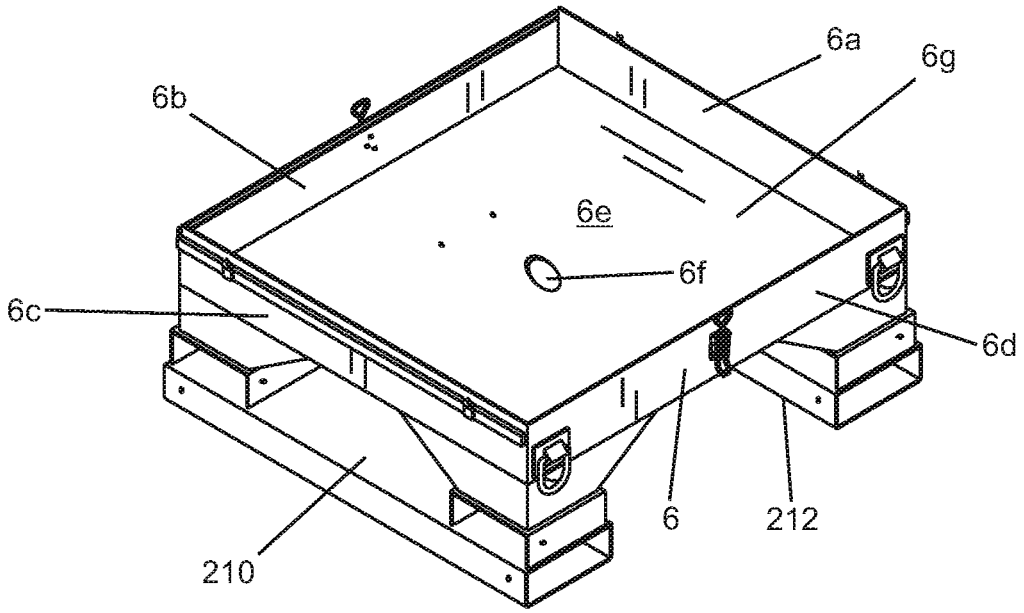
FIG. 12A shows a top, front, and left side perspective view of part of the apparatus of FIG. 2.

FIG. 12A shows a top, front, and left side perspective view of part of the apparatus 200 of FIG. 2. The section or base 6 is shown. The base 6 may include walls 6*a*, 6*b*, 6*c*, and 6*d* and bottom 6*e*, which are attached together and enclose a chamber 6*g* which can retain water and which may be made of a metal material.

Figure 12B:
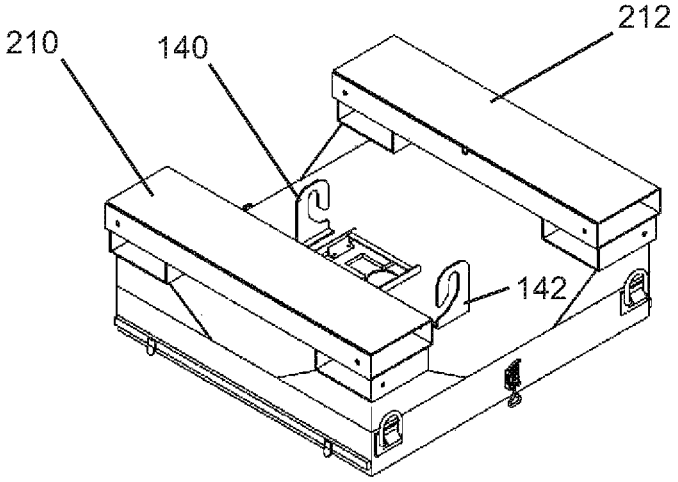
FIG. 12B shows a bottom, left side, and rear perspective view of the part of the apparatus of FIG. 2 shown in FIG. 12A.
Figure 12C:
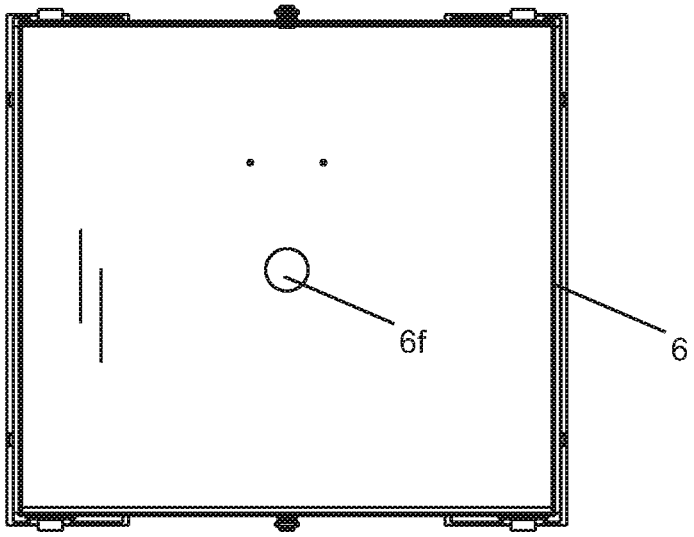
FIG. 12C shows a top view of the part of the apparatus of FIG. 2, shown in FIG. 12A.

FIG. 12B shows a bottom, left side, and rear perspective view of the part of the apparatus 200 of FIG. 2 shown in FIG. 12A;

FIG. 12C shows a top view of the part of the apparatus 200 of FIG. 2, shown in FIG. 12A.

Figure 12D:
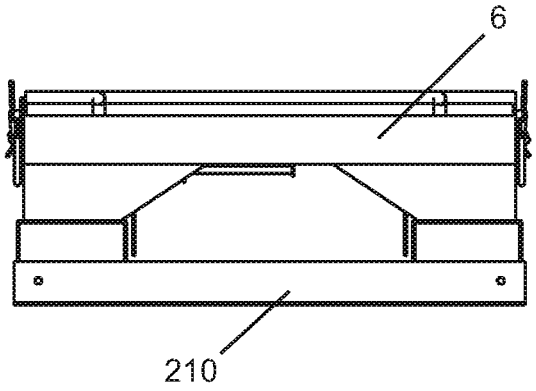
FIG. 12D shows a left side view of the part of the apparatus of FIG. 2, shown in FIG. 12A.

FIG. 12D shows a left side view of the part of the apparatus 200 of FIG. 2, shown in FIG. 12A.

Figure 12E:
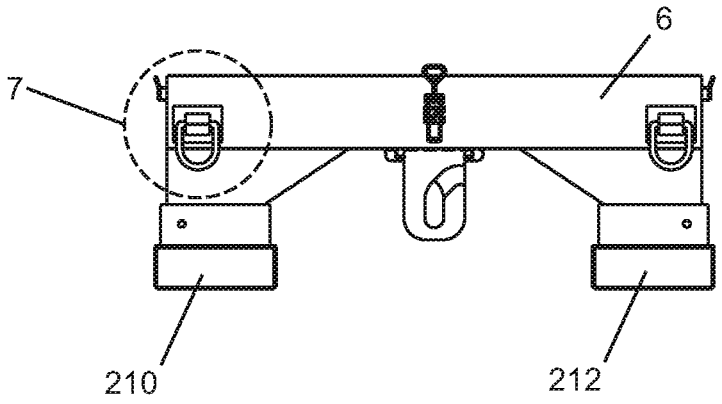
FIG. 12E shows a front view of the part of the apparatus of FIG. 2, shown in FIG. 12A.

FIG. 12E shows a front view of the part of the apparatus 200 of FIG. 2, shown in FIG. 12A.

Figure 12F:
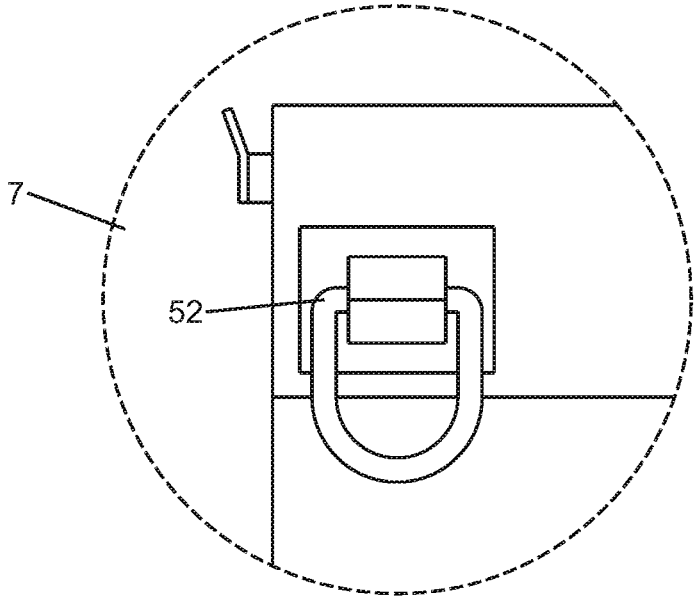
FIG. 12F shows a closeup view a portion of the part of the apparatus, shown in FIG. 12E.

FIG. 12F shows a closeup view a portion of the part of the apparatus 200, shown in FIG. 12E.

Figure 12G:
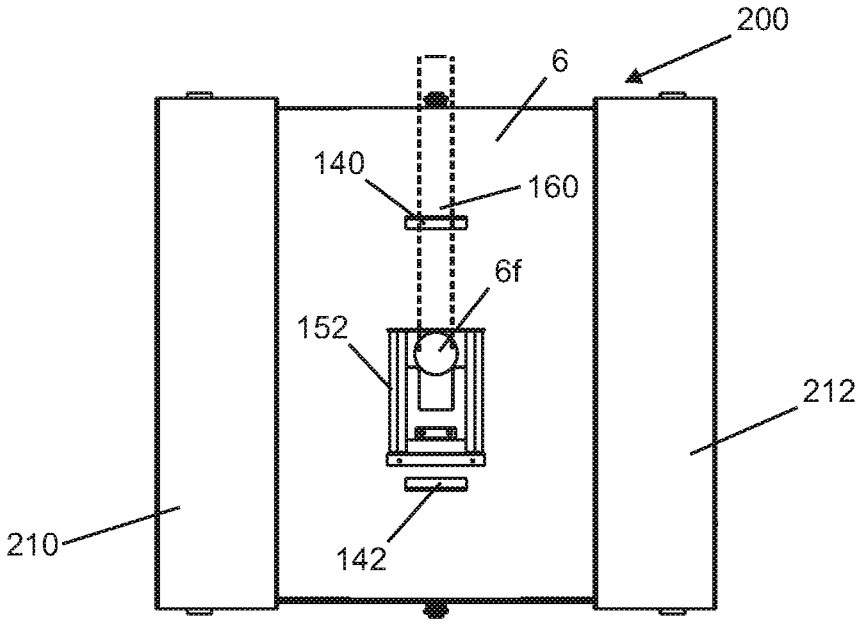
FIG. 12G shows a bottom view of the apparatus of FIG. 2.

FIG. 12G shows a bottom view of the apparatus 200 of FIG. 2.

In operation, the lid 2 may be removed from the apparatus 2 of FIGS. 2-3. Water can be pumped into a chamber defined by walls 4 of FIGS. 2-3, and the base of FIG. 12A. The walls 4 along with the base 6 (including walls 6*a*-6*d*, and bottom 6*e*) define an inner chamber underneath the lid 2. After water is pumped into the inner chamber, it can be released out of opening 6*f* through pipes 162 and 160 out opening 160*a*. There may be a valve located at opening 6*f*. The general water draining operation is known with respect to the known apparatus 1.

In addition, the apparatus 200 can be placed on the support structure, including supports 300, 310, 320, and 330 as shown in FIGS. 9A-9E. Thereafter, the apparatus 200 and supports 300, 310, 320 and 330 can be lifted upwards in the direction U1, shown in FIG. 9E, by a fork lift, by inserting one tine of the forklift in tube 210, and inserting the other tine of the forklift simultaneously in tube 212, and then causing the tines of the fork lift the apparatus 200 and supports 310, 320, and 330 up in the direction U1. A first tine of the forklift is inserted into opening 210*a*, shown in FIG. 9E, of the tube or support 210, so that the first tine extends and sits inside of the entire length or substantially the entire length L1 of the support 210 shown in FIG. 2. A second tine of the forklift is inserted into opening 212*a*, shown in FIG. 9E, of the tube or support 212, so that the first tine extends and sits inside of the entire length or substantially the entire length L1 of the support 212 shown in FIG. 2.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a container having a base, a lid, and walls, wherein the base has a bottom surface, wherein there is an inner chamber enclosed by the base, the lid and the walls;

a first support tube defining a tube axis fixed to the base of the container, such that the first support tube is fixed at a first level below and substantially parallel to the bottom surface of the base;

a second support tube defining a tube axis fixed to the base of the container, such that the second support tube is fixed at the first level below and substantially parallel to the bottom surface of the base, and the second support tube axis is from and spaced apart from and substantially parallel to the first support tube axis;

a third support tube defining a tube axis fixed to the base of the container, such that the third support tube is fixed at a second level below and substantially parallel to the bottom surface of the base, and below and substantially parallel to the first level;

a fourth support tube defining a tube axis fixed to the base of the container, such that the fourth support tube is fixed at the second level below and substantially parallel to the bottom surface of the base, and the fourth support tube is spaced apart from and substantially parallel to the third support tube axis;

wherein the axes of the first and second support tubes are substantially perpendicular to the axes of the third and fourth support tubes;

wherein the third and four support tubes are configured to receive, at the same time, first and second tines, respectively, of a forklift;

wherein the first and second support tubes are configured to receive first and second horizontal members of first and second supports.

2. The apparatus of claim 1 further comprising a fifth support tube defining a tube axis fixed to the base of the container, such that the fifth support tube is fixed at the first level below and substantially parallel to the bottom surface of the base;

a sixth support tube defining a tube axis fixed to the base of the container, such that the sixth support tube is fixed at the first level below and substantially parallel to the bottom surface of the base, and the sixth support tube is spaced apart from and substantially parallel to the fifth support tube axis;

wherein the axes of the fifth and sixth support tubes are substantially perpendicular to the axes of the third and fourth support tubes;

wherein the first and fifth support tubes are substantially aligned;

wherein the second and sixth support tubes are substantially aligned;

wherein the fifth and sixth support tubes are configured to receive third and fourth horizontal members of third and fourth supports.

3. The apparatus of claim 2 further comprising a means for connecting a pipe to the base of the container so that water within the inner chamber of the container can flow out of the container; and wherein the means for connecting a pipe does not overlap any of the first, second, third, fourth, fifth and sixth support tubes.

4. The apparatus of claim 3 wherein the first and second support tubes are configured with respect to each other, and sized to allow a first support to be inserted into the first support tube, while a second support is simultaneously inserted into the second support tube in order to cause the container, and first, second, third, and fourth support tubes, to be raised a distance, above a ground surface, parallel to the bottom surface of the base of the container.

5. The apparatus of claim 3 further comprising a pipe connected to the means for connecting a pipe, in a manner such that at least a portion of the pipe is located between the first and the second support tubes.

6. The apparatus of claim 2 wherein the first, second, third, and fourth support tubes are configured with respect to each other, and sized to allow a first support to be inserted into the first support tube, while a second support is simultaneously inserted into the second support tube, while a third support is simultaneously inserted into the fifth support tube, and while a sixth support is simultaneously inserted into the sixth support tube, in order to cause the container, and first, second, third, fourth, fifth, and sixth support tubes, to be raised a distance, above a ground surface, parallel to the bottom surface of the base of the container.

7. The apparatus of claim 6 wherein the third and fourth support tubes are configured with respect to each other, and sized, to allow a first fork lift tine of a fork lift to be inserted into the third support tube, while a second fork lift tine of the fork lift is simultaneously inserted into the fourth support tube, and while the first, second, third, and fourth supports are inserted into the first, second, fifth, and sixth support tubes.

8. The apparatus of claim 1 wherein the bottom surface of the base has an opening through which liquid can pass.

9. A method of using an apparatus, wherein the apparatus is comprised of a container having a base, a lid, and walls, wherein the base has a bottom surface, wherein there is an inner chamber enclosed by the base, the lid and the walls;

a first support tube defining a tube axis fixed to the base of the container, such that the first support tube is fixed at a first level below and substantially parallel to the bottom surface of the base;

a second support tube defining a tube axis fixed to the base of the container, such that the second support tube is fixed at the first level below and substantially parallel to the bottom surface of the base, and the second support tube axis is from and spaced apart from and substantially parallel to the first support tube axis;

a third support tube defining a tube axis fixed to the base of the container, such that the third support tube is fixed at a second level below and substantially parallel to the bottom surface of the base, and below and substantially parallel to the first level;

a fourth support tube defining a tube axis fixed to the base of the container, such that the fourth support tube is fixed at the second level below and substantially parallel to the bottom surface of the base, and the fourth support tube is spaced apart from and substantially parallel to the third support tube axis;

wherein the axes of the first and second support tubes are substantially perpendicular to the axes of the third and fourth support tubes;

wherein the third and four support tubes are configured to receive, at the same time, first and second tines, respectively, of a forklift;

wherein the first and second support tubes are configured to receive first and second horizontal members of first and second supports, the method comprising the steps of:

inserting a first support into the first support tube, while a second support is simultaneously inserted into the second support tube the third, while a first forklift tine of a forklift is inserted into the third support tube, and while a second forklift tine of the forklift is inserted into the fourth support tube.

10. The method of claim 9

Inserting a third support into a fifth support tube defining an axis and a fourth support into a sixth support tube defining an axis, while the first and second supports are inserted into the first and second support tubes;

wherein the fifth support tube is fixed to the base of the container, such that the fifth support tube is fixed at the first level below and substantially parallel to the bottom surface of the base;

wherein the sixth support tube is fixed to the base of the container, such that the sixth support tube is fixed at the first level below and substantially parallel to the bottom surface of the base, and spaced apart from, substantially parallel to the fifth support tube;

wherein the axes of the fifth and sixth support tubes are substantially perpendicular to the axes of the third and fourth support tubes;

wherein the first and fifth support tubes are substantially aligned; and wherein the second and sixth support tubes are substantially aligned.

11. The method of claim 10 wherein the apparatus includes a means for connecting a pipe to the base of the container so that water within the inner chamber of the container can flow out of the container; and wherein the means for connecting a pipe does not overlap any of the first, second, third, fourth, fifth and sixth support tubes.

12. The method of claim 11 wherein the apparatus includes a pipe connected to the means for connecting a pipe, in a manner such that at least a portion of the pipe is located between the first and the second support tubes.

13. The method of claim 9 wherein the bottom surface of the base has an opening through which liquid can pass.

14. The method of claim 9 further comprising lifting the container above a ground surface, by moving the first forklift tine and the second forklift tine upwards, while the first forklift tine is inserted in the third support tube and the second forklift tine is inserted in the fourth support tube.

* * * * *